US010290975B2

(12) United States Patent
Takane

(10) Patent No.: US 10,290,975 B2
(45) Date of Patent: May 14, 2019

(54) MOVABLE CONNECTOR

(71) Applicant: IRISO ELECTRONICS CO., LTD., Kanagawa (JP)

(72) Inventor: Toru Takane, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days.

(21) Appl. No.: 15/854,915

(22) Filed: Dec. 27, 2017

(65) Prior Publication Data

US 2018/0198234 A1 Jul. 12, 2018

(30) Foreign Application Priority Data

Jan. 11, 2017 (JP) ..... 2017-002959

(51) Int. Cl.

| | |
|---|---|
| ***H01R 12/00*** | (2006.01) |
| ***H01R 13/631*** | (2006.01) |
| ***H01R 13/24*** | (2006.01) |
| ***H01R 13/405*** | (2006.01) |
| ***H01R 12/71*** | (2011.01) |
| ***H01R 12/91*** | (2011.01) |

(52) U.S. Cl.

CPC ..... *H01R 13/6315* (2013.01); *H01R 12/716* (2013.01); *H01R 12/91* (2013.01); *H01R 13/2407* (2013.01); *H01R 13/405* (2013.01)

(58) Field of Classification Search

CPC ..... H01R 23/725; H01R 23/7073; H01R 13/6315; H01R 13/631

USPC ..... 439/74, 660, 247–248

See application file for complete search history.

(56) References Cited

U.S. PATENT DOCUMENTS

| | | | |
|---|---|---|---|
| 9,698,508 | B2 | 7/2017 | Kobayashi et al. |
| 2008/0296133 | A1 | 12/2008 | Ura |
| 2012/0003875 | A1 | 1/2012 | Akai et al. |

FOREIGN PATENT DOCUMENTS

| | | | |
|---|---|---|---|
| EP | 2922150 | A2 | 9/2015 |
| JP | 11-144823 | A | 5/1999 |
| JP | 2007-220542 | A | 8/2007 |
| JP | 2011-076755 | A | 4/2011 |
| JP | 2012-014898 | A | 1/2012 |
| JP | 5849166 | B | 12/2015 |
| JP | 2016-096152 | A | 5/2016 |

OTHER PUBLICATIONS

Office Action for Japanese Patent App. No. 2017-002959 (dated Mar. 20, 2018).

Extended European Search Report for European Patent App. No. 17211084.3 (dated Apr. 17, 2018).

*Primary Examiner* — Phuong Chi T Nguyen

(74) *Attorney, Agent, or Firm* — Cermak Nakajima & McGowan LLP; Tomoko Nakajima

(57) ABSTRACT

To reduce the displacement load of a spring portion in order to improve the workability of insertion and extraction of a movable connector. A spring portion has an upper piece portion and a lower piece portion having a linear shape, and is formed in such a square wave shape that an outer vertical piece portion having a linear portion extends from a first end of the upper piece portion, a central vertical piece portion having a linear shape and connected to a first end of the lower piece portion extends from a second end of the upper piece portion, and an inner vertical piece portion having a linear shape extends from a second end of the lower piece portion.

4 Claims, 6 Drawing Sheets

MOVABLE CONNECTOR

BACKGROUND OF THE INVENTION

1. Field of the Invention

The present invention relates to a movable connector having a floating function.

2. Description of the Related Art

The movable connector is known as an electric connector including a fixed housing fixed to a board, a movable housing fitted and connected to a connection object, and a terminal connecting the fixed housing and the movable housing. The terminal of the movable connector includes a first fixing portion that is fixed to the fixed housing (the first housing), a second fixing portion that is fixed to the movable housing (the second housing), and a spring portion that connects the first fixing portion and the second fixing portion and supports the movable housing displaceably relative to the fixed housing.

The spring portion is formed into a shape having a bent portion curved in an arc shape as shown, for example, in Japanese Patent No. 5849166 (paragraphs 0084 to 0088), and has a function of absorbing displacement of the movable housing moving relative to the fixed housing by elastic deformation of the entire spring portion. Such a function of absorbing displacement of the movable housing by the spring portion can be exerted, for example, at the time of fitting connection in which the movable housing is displaced when inserting a connection object (for example, a connector or a board to be conductively connected) into the movable housing, and when the movable housing is displaced due to vibration or shock under the usage environment after fitting connection with the connection object.

Meanwhile, the movable connector disclosed in Japanese Patent No. 5849166 (paragraph 0084 to 0088) is a Z direction movable connector proposed by the present applicant. The Z direction movable connector is a connector having such a function that in a state where the contact portion of the terminal holds the contact position with the connection object, the spring portion elastically deforms in a direction in which the connection object is inserted into and extracted from the movable connector (Z direction). One characteristic thereof is that even if the spring portion is elastically deformed in the Z direction, the contact portion of the terminal holds the contact position with the connection object. Therefore, since the contact portion does not slide slightly relative to the connection object, abrasion hardly occurs, and there is an advantage that the reliability of the conductive connection hardly deteriorates. However, in order for the contact portion to hold the contact position with the connection object, it is necessary to set the contact pressure of the contact portion with respect to the connection object to be high so that even if the spring portion is elastically deformed in the Z direction, the contact portion does not slide slightly. However, if the contact pressure is set high, insertion and extraction of the connection object into and from the movable connector becomes hard and the workability is lowered.

First of all, in order to improve the workability, it is conceivable to reduce the force required for inserting and extracting the connection object by reducing the contact pressure of the contact portion. However, when the contact pressure is lowered, the holding force for maintaining the contact position with the connection object is decreased, and the risk of the slight sliding is increased. Improvement in workability of insertion and extraction cannot be achieved merely by lowering the contact pressure.

The present invention has been made on the background of the above conventional art. An object of the present invention is to improve workability of insertion and extraction of the movable connector.

SUMMARY OF THE INVENTION

To attain the above object, the present invention is configured to have the following characteristics.

According to the present invention, a movable connector includes a first housing, a second housing that is fitted and connected to a connection object, and a terminal including a first fixing portion fixed to the first housing, a second fixing portion fixed to the second housing, a spring portion connecting the first fixing portion and the second fixing portion and supporting the second housing displaceably relative to the first housing, and a contact portion that makes conductive contact with the connection object. The spring portion has an upper piece portion and a lower piece portion having a linear shape and extending in a direction intersecting with a fitting direction in which the connection object is fitted and connected to the second housing, a first extending portion connecting a first end of the upper piece portion and the first fixing portion, and a second extending portion connecting a second end of the upper piece portion and a first end of the lower piece portion.

As described above, improving the workability of insertion and extraction cannot be achieved merely by lowering the contact pressure of the contact portion. Therefore, the present inventor paid attention to lowering the contact pressure of the contact portion and simultaneously reducing the displacement load of the spring portion. As a result of studies, it was found that, in a terminal having a spring portion having a bent portion curved in an arc shape as shown in the conventional art, when receiving a load of fit connection with a connection object, the stress tends to be dispersed particularly in the longitudinal direction and the plate thickness direction of the arc-shaped bent portion, and therefore a large load is required for the spring portion to obtain a predetermined amount of displacement. In other words, the conventional spring portion has a shape that makes it difficult to reduce the displacement load.

In contrast, the spring portion of the present invention has not a bent portion curved in an arc shape but an upper piece portion and a lower piece portion having a linear shape, and is formed in such a shape that a first extending portion extends from a first end of the upper piece portion, and a second extending portion extends from a second end of the upper piece portion. In the square wave-shaped spring portion in which linear spring pieces are connected by corner portions, stress is not equally distributed in the longitudinal direction and plate thickness direction of the arc-shaped bent portion as in the spring portion of the conventional art. That is, since the upper piece portion, the lower piece portion, the first extending portion, and the second extending portion function as spring pieces connected by corner portions, it is easy to reduce the displacement load of the spring portion. Therefore, in the movable connector of the present invention, since the displacement load of the spring portion can be reduced, not only the contact pressure of the contact portion but also the displacement load of the spring portion can be reduced, thereby improving the workability of insertion and extraction. Therefore, if this is applied to the above-mentioned Z direction movable connector, it is possible to realize a Z direction movable connector having high reliability of conductive connection and good workability of insertion and extraction. Further, the movable connector of the present invention can also be configured as a movable connector that is not a Z direction movable connector, and a movable connector in which the displacement load of the spring portion is small and the second housing is displaced by flexible elastic deformation can be realized.

In order to configure the movable connector of the present invention as the Z direction movable connector, it is preferable that the displacement load at which the spring portion is displaced is smaller than the load at which the contact portion is displaced from the contact position at which the contact portion is in press contact with the connection object. According to this, since even if the spring portion is displaced, the contact portion holds the contact position with the connection object, the contact portion does not slide slightly relative to the connection object, so that abrasion hardly occurs, and it is possible to realize a Z direction movable connector having high reliability of conductive connection.

The second extending portion may have such a shape that it extends obliquely so as to be gradually separated from the first extending portion from the second end of the upper piece portion toward the first end of the lower piece portion. According to this, it is possible to prevent the second extending portion from coming into contact with the first extending portion when the upper piece portion and the lower piece portion are displaced towards each other.

The upper piece portion may be formed to be longer than the lower piece portion. The second housing can be grasped as a movable housing displaceable relative to the first housing, and the first housing can be grasped as a fixed housing. Here, among the upper piece portion and the lower piece portion, the closer portion to the first housing which is the fixed housing is the upper piece portion. If the upper piece portion is formed to be longer than the lower piece portion, the displacement load of the spring portion can be further reduced.

According to the movable connector of the present invention, it is possible to reduce the displacement load of the spring portion. Therefore, when this is applied to, for example, a Z direction movable connector, the contact pressure of the contact portion is reduced and the displacement load of the spring portion can be reduced. Therefore, even if the spring portion is displaced in the Z direction, the contact portion does not slide slightly, so that abrasion hardly occurs, and workability of insertion and extraction of the connection object can be improved while achieving high reliability of conductive connection. With respect to the movable connector that is not the Z direction movable connector, the displacement load of the spring portion can be reduced. In other words, it is possible to increase the amount of displacement (movable amount) when the displacement load is fixed.

DESCRIPTION OF THE PREFERRED EMBODIMENTS

Figure 1:
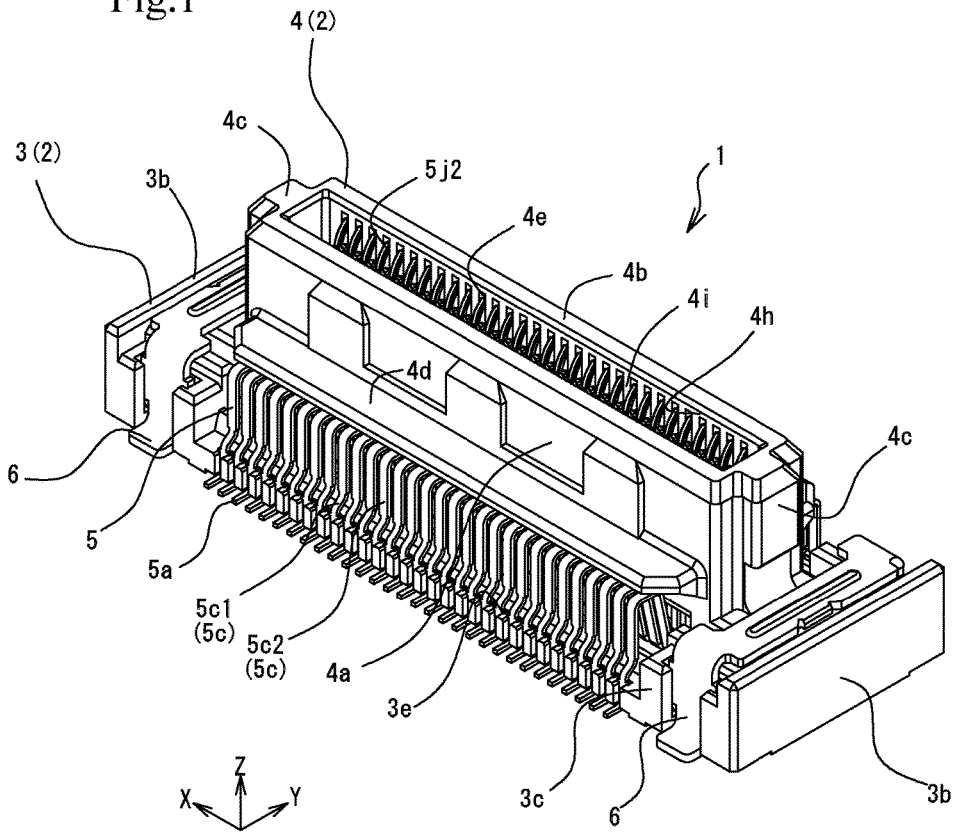
FIG. 1 is a perspective view including the front, right side, and top of a movable connector according to an embodiment.
Figure 2:
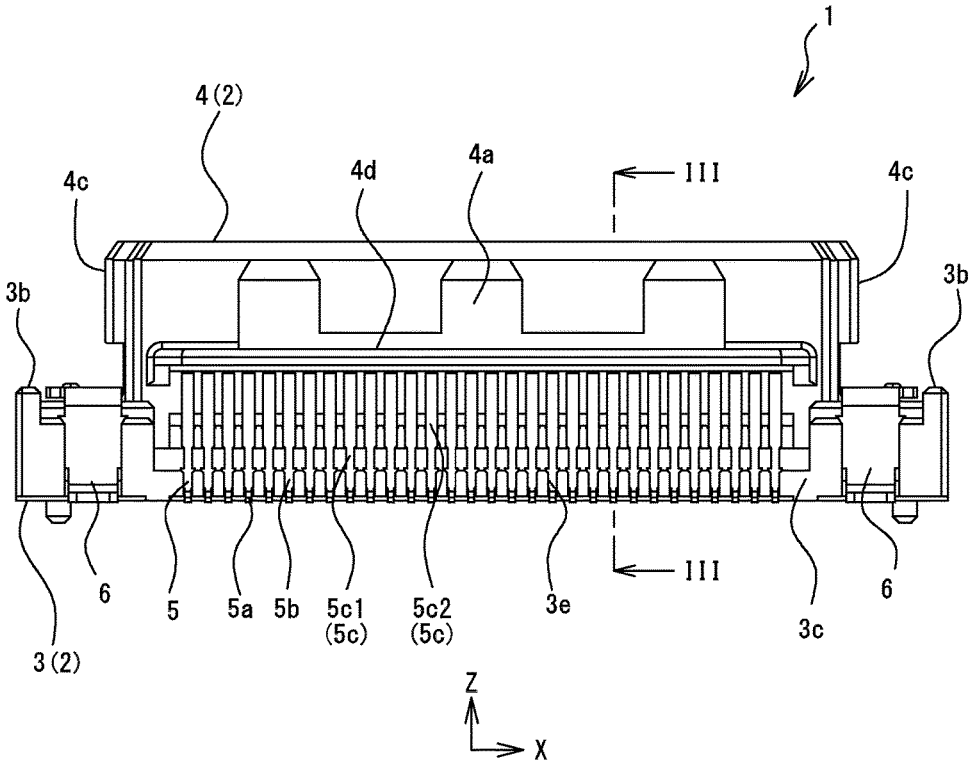
FIG. 2 is a front view of the movable connector of FIG. 1.

Hereinafter, an embodiment of the present invention will be described with reference to the drawings. In the present specification, claims, and drawings, the arrangement direction (the left-right direction) of the terminals of the movable connector shown in FIG. 1 is the X direction, the depth direction (the front-rear direction) of the movable connector is the Y direction, and the height direction (the up-down direction) is the Z direction. However, such specifying of left-right, front-rear, and up-down does not limit the mounting direction and use direction of the movable connector of the present invention.

Configuration of Movable Connector 1

The movable connector 1 includes a housing 2 molded of a hard resin. The housing 2 is composed of a fixed housing 3 as a "first housing" and a movable housing 4 as a "second housing." Terminals 5 are metal pieces and are each fixed to the fixed housing 3 and the movable housing 4.

The fixed housing 3 is mounted on a board P. The fixed housing 3 is formed in a rectangular shape whose longitudinal direction is along the X direction. The fixed housing 3 has a bottom wall portion 3*a* formed in rectangle and single plate-shaped (FIG. 3), so that the movable housing 4 and the terminals 5 disposed on the fixed housing 3 are not exposed to the board P. This prevents the board P from being bowed by being pressed by the movable housing 4 and thereby damaging the elements, the circuit wiring, and the soldered portions, so that the surface just under the bottom wall portion 3*a* can be used for circuit wiring. Side wall portions 3*b* are formed at both ends of the bottom wall portion 3*a*, and fixing metal fittings 6 to be soldered to the board P are fixed to the side wall portions 3*b*. On the bottom wall portion 3*a*, a front wall portion 3*c* and a rear wall portion 3*d* are formed along the longitudinal edge of the bottom wall portion 3*a*. On the front wall portion 3*c* and the rear wall portion 3*d*, there are formed terminal fixing portions 3*e* that hold and fix the fixed housing fixing portion 5*b* of each of the arranged terminals 5 in the plate width direction (X direction).

As with the fixed housing 3, the movable housing 4 is formed in a rectangular tube shape whose longitudinal direction is along the X direction, and includes a front wall portion 4*a*, a rear wall portion 4*b*, and left and right wall portions 4*c*.

Figure 3:
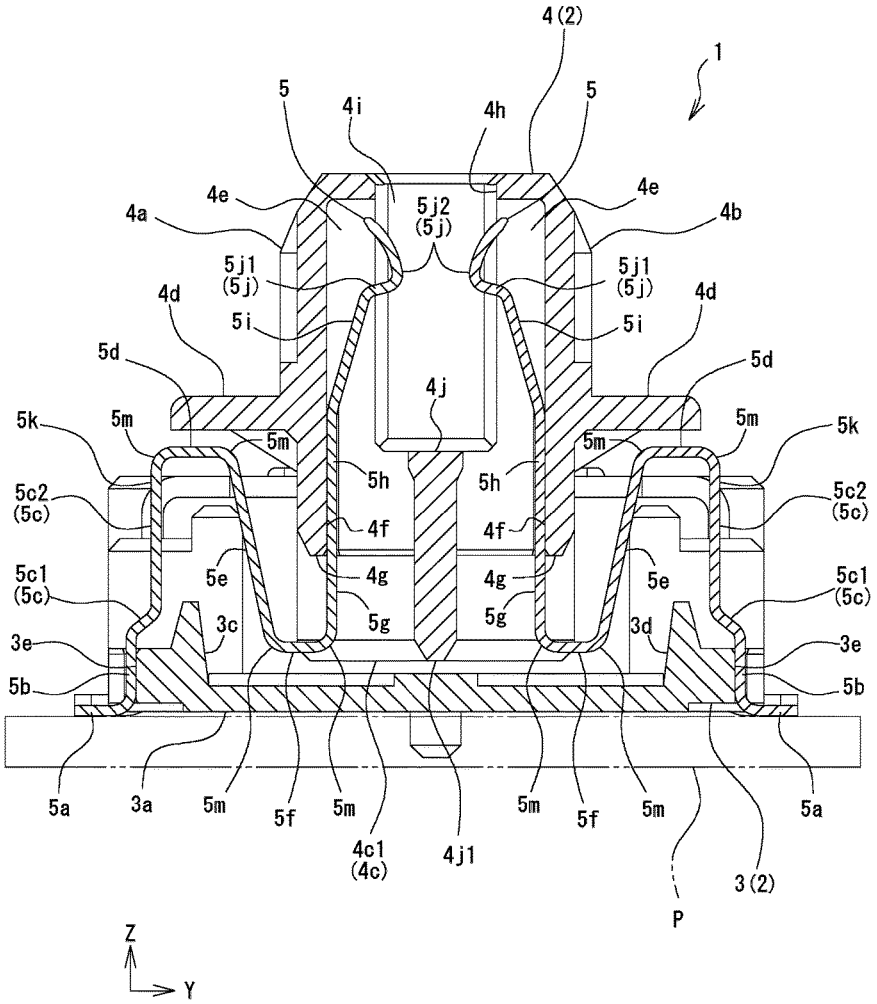
FIG. 3 is an enlarged sectional view taken along line III-III of FIG. 2.
Figure 4:
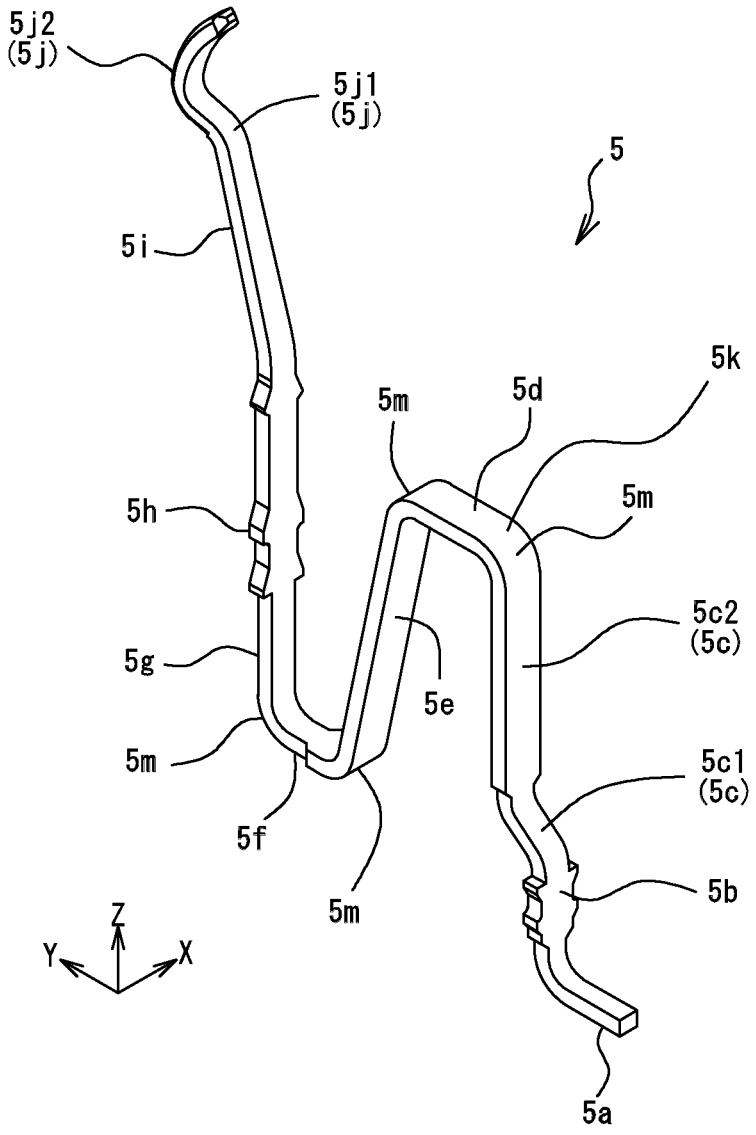
FIG. 4 is an exterior perspective view of a terminal provided in the movable connector of FIG. 1.

Eave-shaped protrusions 4*d* are formed on the outer surfaces of the front wall portion 4*a* and the rear wall portion 4*b*, and protect the terminals 5 thereunder from damage due to contact or the like. Slit-like terminal accommodating chambers 4*e* are formed in the inner surfaces of the front wall portion 4*a* and the rear wall portion 4*b*. The terminals 5 arranged along the X direction are each accommodated in a separate one of the terminal receiving chambers 4*e*. Terminal fixing portions 4*f* for fixing the terminals 5 are formed in the terminal accommodating chambers 4*e*, and fix the movable housing fixing portions 5*h* of the terminals 5 to the movable housing 4 by holding them in the plate width direction (X direction). Under the lower edges of the front wall portion 4*a* and the rear wall portion 4*b*, there are formed passing portions 4*g* for passing the lower piece portions 5*f* of the terminals 5 therethrough from the inside to the outside of the terminal accommodating chambers 4*e* of the movable housing 4 (FIG. 3). Since having the passing portions 4*g*, the front wall portion 4*a* and the rear wall portion 4*b* are formed shorter than the left and right side wall portions 4*c* on the lower side in the Z direction.

A fitting opening 4*h* for inserting a connection object is formed in the top surface of the movable housing 4, and a fitting chamber 4*i* is formed inside the opening. Under the fitting chamber 4*i*, a central partition wall 4*j* is formed at the center position in the Y direction along the X direction (FIG. 3). The connection object comes into contact with the central partition wall 4*j* so that excessive insertion of the connection object into the fitting chamber 4*i* can be stopped.

As shown in FIG. 3, the bottom surface portions 4*c*1 of the left and right side wall portions 4*c* of the movable housing 4 and the bottom surface portion 4*j*1 of the central partition wall 4*j* serve as stoppers that stop the displacement of the movable housing 4 by the movable housing 4 coming into contact with the bottom wall portion 3*a* of the fixed housing 3, the movable housing being displaced downward in the Z direction.

The terminals 5 are arranged along the X direction in parallel with the movable connector 1, and are disposed in two rows opposite in the Y direction. The terminals 5 have the same shape. Specifically, each of the terminals 5 has a board connecting portion 5*a*, a fixed housing fixing portion 5*b* as a "first fixing portion", an outer vertical piece portion 5*c* as a "first extending portion", an upper piece portion 5*d*, a central vertical piece portion 5*e* as a "second extending portion", a lower piece portion 5*f*, an inner vertical piece portion 5*g*, a movable housing fixing portion 5*h* as a "second fixing portion", an elastic arm 5*i*, and a contact portion 5*j*. Of these, the outer vertical piece portion 5*c*, the upper piece portion 5*d*, the central vertical piece portion 5*e*, the lower piece portion 5*f*, and the inner vertical piece portion 5*g* form a square wave-shaped spring portion 5*k*.

The board connecting portion 5*a* is a portion soldered to a circuit contact (not shown) of the board P and conductively connected to the board circuit.

The fixed housing fixing portion 5*b* and the movable housing fixing portion 5*h* are formed as fixing protrusions protruding in the plate width direction of the terminal 5. The fixed housing fixing portion 5*b* is press-fitted into and held by the terminal fixing portion 3*e* of the fixed housing 3 to fix a first end of the terminal 5 to the fixed housing 3. The movable housing fixing portion 5*h* is press-fitted into and held by the terminal fixing portion 4*f* of the movable housing 4 to fix a second end of the terminal 5 to the movable housing 4.

The outer vertical piece portion 5*c* is a portion that is in the square wave-shaped spring portion 5*k* and is exposed to the outside of the movable connector 1. A bent portion 5*c*1 is formed in the outer vertical piece portion 5*c*, and a linear portion 5*c*2 having a linear shape extending upward in the Z direction is formed over the bent portion 5*c*1.

The upper piece portion 5*d* and the lower piece portion 5*f* are formed in a linear shape extending in a direction (Y direction) intersecting with the fitting direction (Z direction) of the connection object inserted into the fitting chamber 4*i* of the movable housing 4. The upper piece portion 5*d* is located on the upper side of the square wave-shaped spring portion 5*k*, and the lower piece portion 5*f* is located on the lower side.

The central vertical piece portion 5*e* is a portion connecting the upper piece portion 5*d* and the lower piece portion 5*f* in the square wave-shaped spring portion 5*k*. The central vertical piece portion 5*e* is formed so as to extend obliquely so as to be gradually separated from the outer vertical piece portion 5*c* from the upper end toward the lower end. By thus forming it obliquely, it is possible to set a large gap between the lower end of the central vertical piece portion 5*e* and the front wall portion 3*c* and the rear wall portion 3*d* of the fixed housing 3, so that it is possible to secure a large amount of displacement of the lower piece portion 5*f* and the movable housing 4 in the Y direction. In the case where the fixed housing 3 does not have the front wall portion 3*c* and the rear wall portion 3*d* as in this embodiment, the gap between the lower end of the central vertical piece portion 5*e* and the outer vertical piece portion 5*c* can be set large, and it is possible to prevent them from being brought into contact due to displacement.

The inner vertical piece portion 5*g* is a portion that is in the square wave-shaped spring portion 5*k* and is located on the lower side of the movable housing 4. A first end of the inner vertical piece portion 5*g* is connected to the lower piece portion 5*f*, and a second end of the inner vertical piece portion 5*g* is connected to the movable housing fixing portion 5*h*. That is, the inner vertical piece portion 5*g* is formed in a linear shape extending in the fitting direction (Z direction) of the connection object inserted into the fitting chamber 4*i* of the movable housing 4, and has a function of supporting the movable housing 4 from below. Therefore, at the time of fitting connection of the connection object to the movable housing 4, the inner vertical piece portion 5*g* serves as a portion that receives the insertion force of the connection object along the Z direction.

The elastic arm 5*i* is formed obliquely so as to approach the fitting chamber 4*i* from the proximal end connected to the movable housing fixing portion 5*h* toward the distal end side connected to the contact portion 5*j*. The elastic arm 5*i* is a portion that elastically supports the contact portion 5*j* displaceably.

The contact portion 5*j* is a portion that makes conductive contact with the connection object. A bent portion 5*j*1 connected to the elastic arm 5*i* and bending toward the fitting chamber 4*i* is formed in the contact portion 5*j*. At the distal end of the bent portion 5*j*1, a contact 5*j*2 that is greatly curved in a mountain shape is formed. The distal end of the contact 5*j*2 is located in the terminal accommodating chamber 4*e* of the movable housing 4 so that the connection object is not caught on the distal end and the contact portion 5*j* and the elastic arm 5*i* do not buckle.

Operation and Effect of Movable Connector 1

Next, the operation and effect of the movable connector 1 will be described.

The movable connector 1 of this embodiment is configured as a so-called Z direction movable connector. That is, in the state where the movable connector 1 is fitted and connected to the connection object, the displacement load at which the spring portion 5*k* is displaced is smaller than the load at which the contact portion 5*j* is slid and displaced from the contact position at which the contact portion 5*j* is in press contact with the connection object. Therefore, even if the spring portion 5*k* is displaced, the contact portion 5*j* holds the contact position with the connection object by the contact pressure. Therefore, since the contact 5*j*2 does not slide slightly relative to the connection object, abrasion such as plating peeling hardly occurs, and the movable connector 1 can exert high reliability of conductive connection while the movable housing 4 is displaceable.

However, although the contact pressure by the contact portion 5*j* exerts a holding force that prevents displacement relative to the connection object, it is set smaller than in the movable connector shown in the conventional art (Japanese Patent No. 5849166 (paragraphs 0084 to 0088)), and the displacement load of the spring portion 5*k* is also set smaller.

The spring portion 5*k* has, instead of a bent portion curved in an arc shape, an upper piece portion 5*d* and a lower piece portion 5*f* having a linear shape, and is formed in such a square wave shape that an outer vertical piece portion 5*c* having a linear portion 5*c*2 extends from a first end of the upper piece portion 5*d*, a central vertical piece portion 5*e* having a linear shape and connected to a first end of the lower piece portion 5*f* extends from a second end of the upper piece portion 5*d*, and an inner vertical piece portion 5*g* having a linear shape extends from a second end of the lower piece portion 5*f*.

The square wave-shaped spring portion 5*k* in which a plurality of linear spring pieces are connected by corner portions 5*m* as described above has a characteristic that, as described below, the stress generated when the spring portion 5*k* is displaced in the Y direction and the Z direction is less likely to be dispersed over the entire spring portion 5*k* than the round wave-shaped spring portion of the conventional art having a curved bent portion.

Figure 6A:
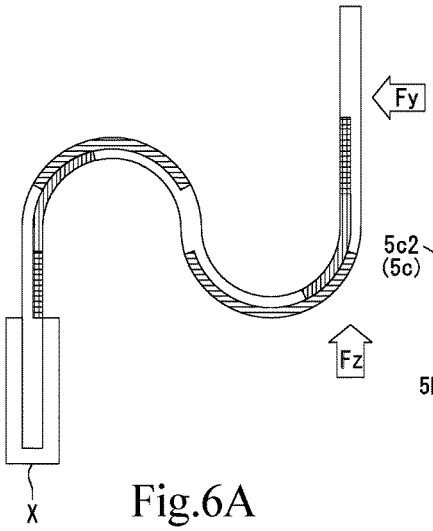
FIGS. 6A to 6D are explanatory views schematically showing the stress distributions of the spring portions according to the embodiment and comparative examples.
Figure 6B:
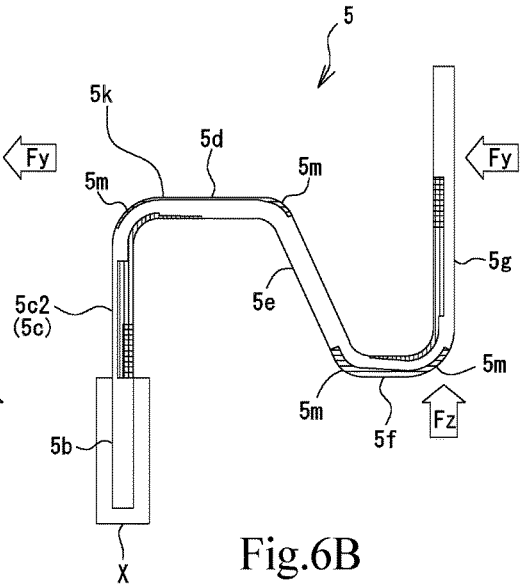

FIG. 6A is a schematic diagram of the stress distribution generated in the round wave-shaped spring portion of the conventional art, and FIG. 6B is a schematic diagram of the stress distribution generated in the square wave-shaped spring portion 5*k* of this embodiment. In FIGS. 6A to 6D, each terminal is fixed at the fixing portion X, the simulation result of the stress distribution when the load Fy in the Y direction acts is schematically shown by horizontal hatching, and the simulation result of the stress distribution when the load Fz in the Z direction acts is schematically shown by vertical hatching.

In the conventional round wave-shaped spring portion, when a load Fy is applied, stress is generated over the entire length of the two curved portions, and stress is generated deeply also in the plate thickness direction, and stress is generated throughout the round wave-shaped spring portion. In contrast, in the square wave-shaped spring portion 5*k* according to this embodiment, when a load Fy is applied, stress is distributed in the surface layer portions of the upper piece portion 5*d*, the lower piece portion 5*f*, and the corner portions 5*m*, and in the plate thickness direction, the stress is not distributed more deeply than in the spring portion of the conventional art. Similarly, when the load Fz acts upward in the Z direction, in the round wave-shaped spring portion, stress is generated deeply in the plate thickness direction whereas in the square wave-shape spring portion 5*k*, stress is generated in the surface layer portions of the corner portions 5*m*. Therefore, in the spring portion 5*k* of this embodiment, the displacement load can be reduced, and when the same load is applied, the amount of displacement can be increased.

Figure 6C:
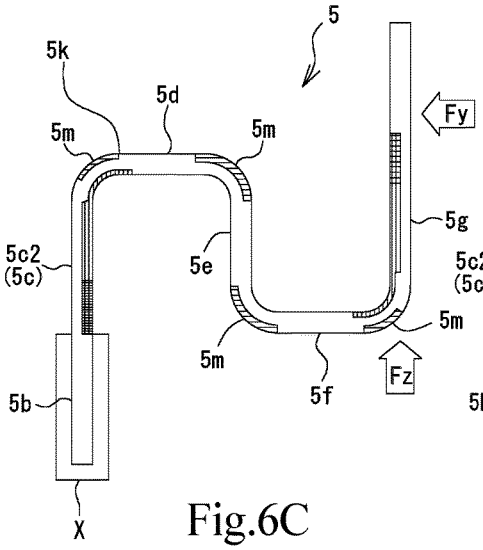

In addition, although the central vertical piece 5*e* is formed obliquely, as compared with a modification in which the central vertical piece extends in the vertical direction as shown in FIG. 6C, since the central vertical piece 5*e* extends obliquely, the spring length is long, so it can be seen that displacement load can be reduced.

Since, in the movable connector 1, the displacement load of the spring portion 5*k* can be reduced, both the contact pressure by the contact portion 5*j* and the displacement load of the spring portion 5*k* can be reduced. Therefore, it is possible to realize a Z-direction movable connector that has good workability of inserting and extracting a connection object and has high reliability of conductive connection.

The upper piece portion 5*d* of the spring portion 5*k* is formed to be longer than the lower piece portion 5*f*. When the upper piece portion 5*d* on the fixed housing 3 side is lengthened, the displacement load of the whole spring portion 5*k* can be further reduced. That is, FIG. 6D is a schematic diagram of a simulation result of a stress distribution corresponding to a modification of FIG. 5B to be described later. When comparing the upper piece portions 5*d* to each other, the upper piece portion 5*d* of this embodiment is more flexible because the spring length is long, and the stress generated in the plate thickness direction is small. Therefore, by forming the upper piece portion 5*d* longer than the lower piece portion 5*f*, it is possible to further reduce the displacement load of the spring portion 5*k*.

Figure 5A:
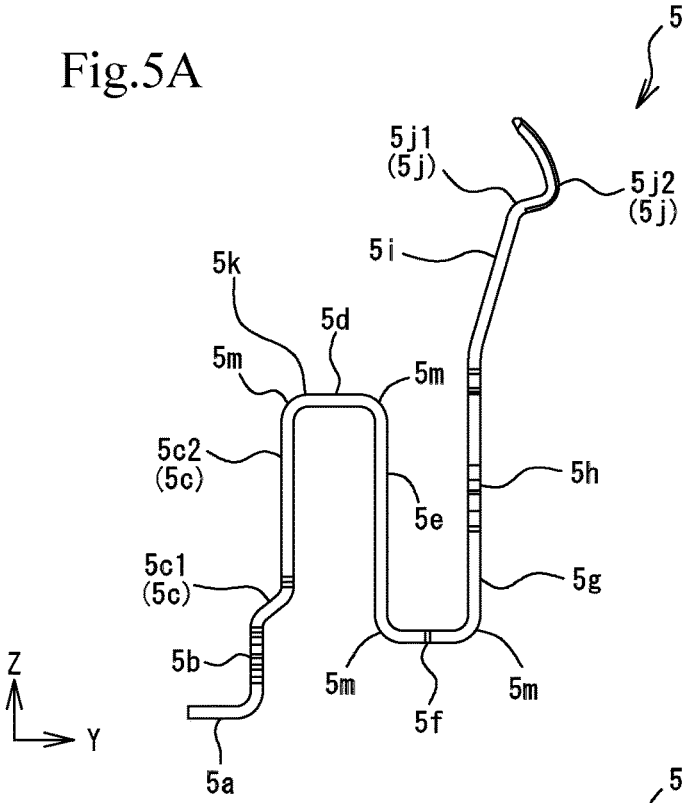
FIGS. 5A and 5B are explanatory views showing modifications of the spring portion of the terminal.
Figure 5B:
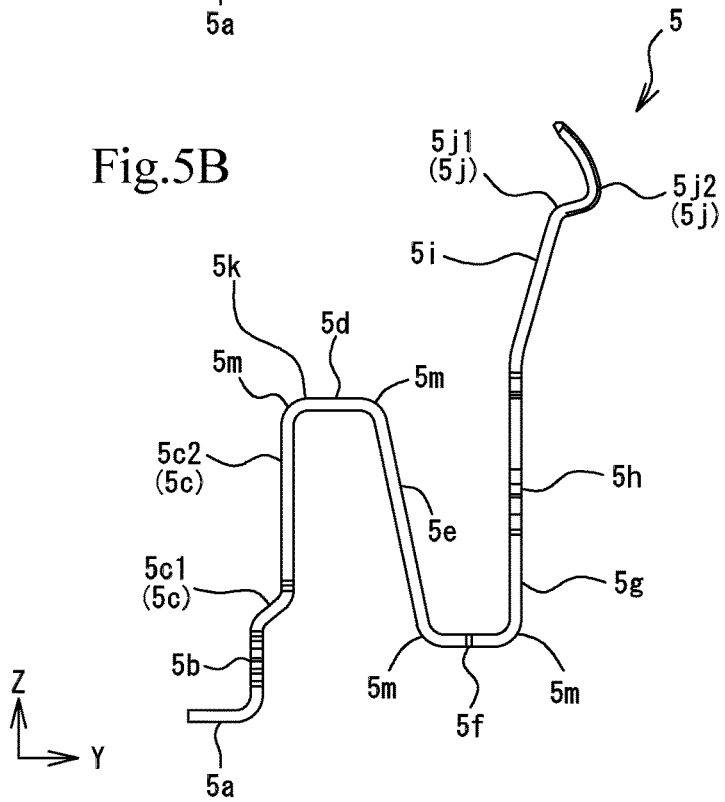
Figure 6D:
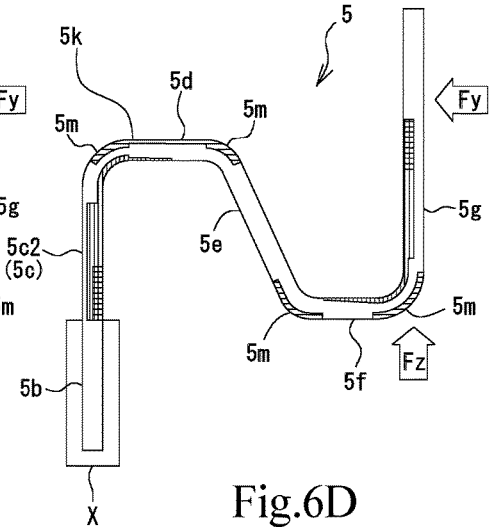

Modifications of Embodiment (FIGS. 5A and 5B)

Since the above embodiment can be implemented in modifications, an example thereof will be described.

The shape of the spring portion 5*k* shown in the above embodiment is an example, and other shapes shown in FIGS. 5A and 5B, for example, can be used. In FIG. 5A, the central vertical piece 5*e* is formed to extend in the vertical direction, and the upper piece portion 5*d* and the lower piece portion 5*f* have the same length. In FIG. 5B, the upper piece portion 5*d* and the lower piece portion 5*f* have the same length. Even with these spring portions 5*k*, the displacement load can be made smaller than that of the spring portion of the conventional art.

In the above embodiment, the outer vertical piece portion 5*c* has the bent portion 5*c*1, but the outer vertical piece portion 5*c* may have only the straight portion 5*c*2.

In the above embodiment, the spring portion 5*k* has the inner vertical piece portion 5*g*. However, the spring portion 5*k* may not have the inner vertical piece portion 5*g*, and the terminal 5 may have such a shape that the end of the lower piece portion 5*f* is directly connected to the movable housing fixing portion 5*h*.

What is claimed is:

1. A movable connector comprising:

a first housing;

a second housing that is fitted and connected to a connection object; and a terminal including a first fixing portion fixed to the first housing, a second fixing portion fixed to the second housing, a spring portion connecting the first fixing portion and the second fixing portion and supporting the second housing displaceably relative to the first housing, and a contact portion that makes conductive contact with the connection object, wherein the spring portion has an upper piece portion and a lower piece portion having a linear shape, extending in a direction intersecting with a fitting direction in which the connection object is fitted and connected to the second housing, and being displaceable in the fitting direction and the direction intersecting with the fitting direction, a first extending portion connecting a first end of the upper piece portion and the first fixing portion and at least being displaceable in the direction intersecting with the fitting direction, and a second extending portion connecting a second end of the upper piece portion and a first end of the lower piece portion and being displaceable in the fitting direction and the direction intersecting with the fitting direction, and wherein the second housing being displaceable due to displacement of the spring portion in the fitting direction and the direction intersecting with the fitting direction in the state where the second housing is fitted and connected to the connection object.

2. The movable connector according to claim 1, wherein the second extending portion has such a shape that it extends obliquely so as to be gradually separated from the first extending portion from the second end of the upper piece portion toward the first end of the lower piece portion.

3. The movable connector according to claim 1, wherein the upper piece portion is formed to be longer than the lower piece portion.

4. The movable connector according to claim 1, wherein the first extending portion has a linear portion that has a first end connecting the first end of the upper piece portion and a bent portion that connects the linear portion and bends toward outside of the first housing.

* * * * *